US007866475B2

(12) United States Patent
Doskoczynski et al.

(10) Patent No.: US 7,866,475 B2
(45) Date of Patent: Jan. 11, 2011

(54) BLISTER PACKAGE

(75) Inventors: William Doskoczynski, Stewartsville, NJ (US); Steven Ginsberg, Montville, NJ (US); Barry G. Seelig, New York, NY (US); Anne Carls, Hamburg (DE); Karel Golta, Hamburg (DE)

(73) Assignee: McNeil-PPC, Inc., Skillman, NJ (US)

( * ) Notice: Subject to any disclaimer, the term of this patent is extended or adjusted under 35 U.S.C. 154(b) by 575 days.

(21) Appl. No.: 11/451,160

(22) Filed: Jun. 12, 2006

(65) Prior Publication Data

US 2007/0284279 A1 Dec. 13, 2007

(51) Int. Cl.
*B65D 83/04* (2006.01)
*B65D 85/42* (2006.01)

(52) U.S. Cl. ..... 206/532; 206/530; 206/536; 206/528

(58) Field of Classification Search ..... 206/532, 206/528, 529, 530, 531, 438, 484, 470, 471, 206/462, 534.2, 533, 536, 461; 383/207, 383/208, 209; 53/412, 133.3, 133.8, 453, 53/559

See application file for complete search history.

(56) References Cited

U.S. PATENT DOCUMENTS

| | | | | | |
|---|---|---|---|---|---|
| 2,329,360 | A | * | 9/1943 | Salfisberg | 206/484 |
| 3,202,280 | A | * | 8/1965 | Larson | 206/471 |
| 3,301,395 | A | * | 1/1967 | Swezey | 206/463 |
| 3,406,492 | A | * | 10/1968 | Ludwig | 53/453 |
| 3,809,220 | A | * | 5/1974 | Arcudi | 206/484 |
| 3,835,995 | A | | 9/1974 | Haines | |
| 3,872,970 | A | | 3/1975 | Edison | |
| 4,371,080 | A | | 2/1983 | Haines | |
| 4,398,634 | A | * | 8/1983 | McClosky | 206/532 |
| 5,088,603 | A | * | 2/1992 | Kirkpatrick | 206/530 |
| D349,457 | S | * | 8/1994 | Nottingham et al. | D9/415 |
| 5,511,665 | A | * | 4/1996 | Dressel et al. | 206/532 |
| 5,529,188 | A | | 6/1996 | Coggswell | |
| 5,551,567 | A | * | 9/1996 | Malone et al. | 206/469 |
| 5,758,774 | A | | 6/1998 | Leblong | |
| 5,785,180 | A | | 7/1998 | Dressel et al. | |
| 5,873,466 | A | * | 2/1999 | Hulick | 206/531 |

(Continued)

FOREIGN PATENT DOCUMENTS

| | | |
|---|---|---|
| DE | 2224965 | 12/1973 |

(Continued)

*Primary Examiner*—Mickey Yu
*Assistant Examiner*—Chun Cheung
(74) *Attorney, Agent, or Firm*—Karen G. Horowitz

(57) ABSTRACT

A child-resistant multi-step tear-access blister package having at least one product well containing a product. The product is accessed by tearing the blister package from a peripheral edge toward the product well. A step in addition to tearing is required to access the product, thereby elevating the cognitive skill necessary to access the product above those of a typical small child. In the disclosed exemplary embodiment, the additional step involves weakening a tear-resistant channel blocking a tear path from the peripheral edge of the package to the product well. More particularly, initial tearing of the package toward the product well is interfered with by the presence of the tear-resistant channel interrupting the tear path. The tear-resistant channel may be bent or snapped to permit tearing therethrough and to permit continued tearing of the blister package toward the product well to access the product.

19 Claims, 3 Drawing Sheets

U.S. PATENT DOCUMENTS

| | | | | |
|---|---|---|---|---|
| 5,899,333 | A * | 5/1999 | Williams et al. | 206/469 |
| 6,036,016 | A * | 3/2000 | Arnold | 206/532 |
| 6,199,698 | B1 * | 3/2001 | Hetrick et al. | 206/532 |
| 6,227,369 | B1 * | 5/2001 | Glassman | 206/469 |
| 6,276,529 | B1 * | 8/2001 | Feehan, Jr. | 206/469 |
| 6,352,158 | B1 * | 3/2002 | Cole-Bennett et al. | 206/532 |
| 6,364,114 | B1 * | 4/2002 | Glassman | 206/469 |
| 6,422,391 | B1 * | 7/2002 | Swartz | 206/531 |
| 6,516,949 | B2 | 2/2003 | Fuller et al. | |
| 6,899,222 | B2 * | 5/2005 | Jones et al. | 206/305 |
| 2003/0111379 | A1 | 6/2003 | Intini | |
| 2006/0027480 | A1 | 2/2006 | Buss | |

FOREIGN PATENT DOCUMENTS

| | | |
|---|---|---|
| DE | 2515016 | 4/1975 |
| DE | 7924640 | 3/1980 |
| EP | 679587 | 4/1995 |
| EP | 1301415 | 4/2004 |
| EP | 1778551 | 2/2006 |
| FR | 2198461 | 3/1974 |
| FR | 2660634 | 4/1990 |
| FR | 2751632 | 1/1998 |
| GB | 1450905 | 9/1976 |
| GB | 1490608 | 2/1977 |
| WO | 0204314 | 1/2002 |
| WO | 2005087614 | 9/2005 |

* cited by examiner

FIG. 1
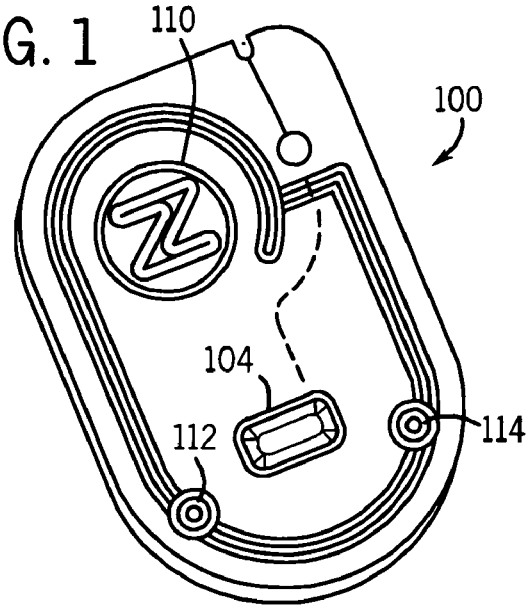
FIG. 2
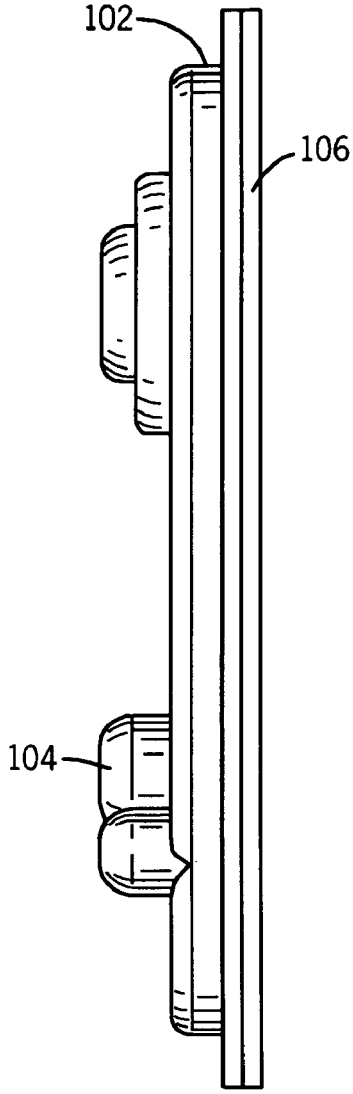
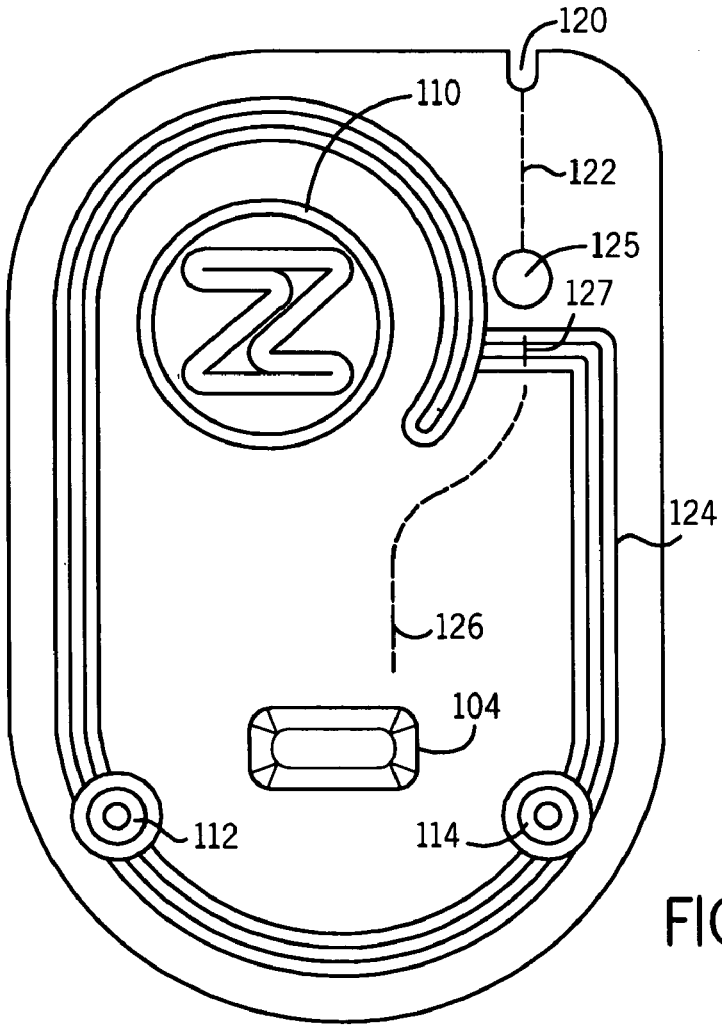
FIG. 3

FIG. 7
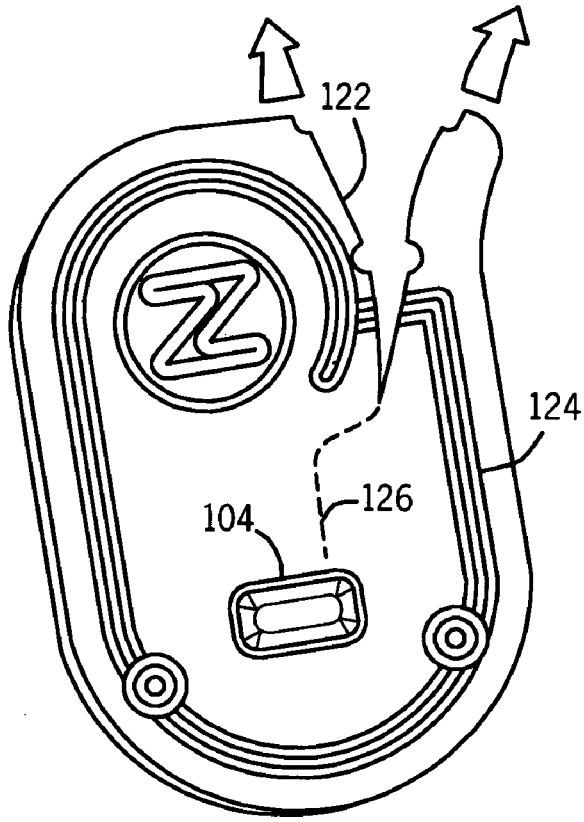
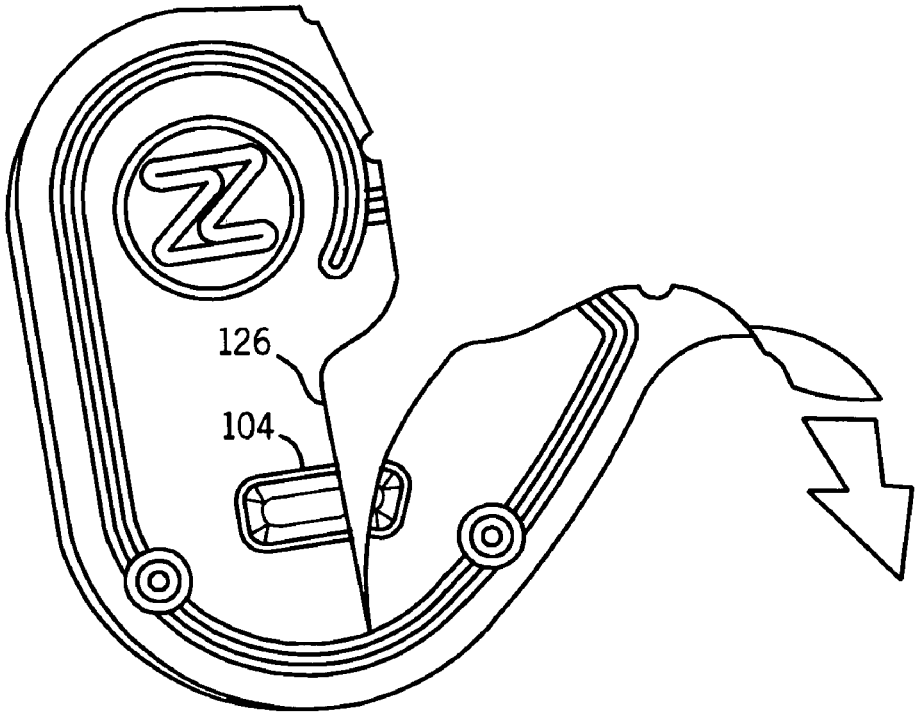
FIG. 8

BLISTER PACKAGE

FIELD OF THE INVENTION

The present invention relates to a blister package that is difficult for a small child to open, yet readily opened by an adult, including senior and physically disabled adults.

BACKGROUND OF THE INVENTION

A wide variety of blister packages for packaging a variety of consumer products are available in the art. These blister packages typically are formed of a transparent layer (the "blister") coupled (preferably sealed or otherwise bonded) to a backing layer. The blister has a well or cavity or other type of deformation formed therein such that upon coupling of the blister to the backing layer a compartment or pouch is formed for holding or containing a desired product. The product well(s) may be accessed by stripping the backing layer from the package to expose the well and the product therein, or to expose a rupturable/push-through backing layer below the well through which the product may be pushed upon exerting pressure on the blister and the article (a "peel-and-push" blister package). Alternatively, the well(s) may be accessed by tearing the edge of the package toward such well(s) (a "tear-access" blister package). A starting notch or slit may be provided to facilitate tearing.

One common use of blister packages is for packaging solid-dose medications or pharmaceuticals (e.g., tablets, capsules, caplets, and the like; hereinafter "medications" for the sake of convenience and with no intent to limit) or consumer products. Such packaging typically is desirable for carrying individual/unit doses of medication, and may afford a greater level of portability than other types of packaging (e.g., bottles). Like typical blister packages, blister packages for medications generally permit moderately easy viewing of the contents therein. Such easy viewing may tempt a small child to try to access the product. The Consumer Product Safety Commission has established rules governing which products require special packaging and standards for such special packaging in the Poison Prevention Packaging Act of 1970, outlined in the Code of Federal Regulations, Title 16, Part 1700. "Special packaging," commonly referenced as child-resistant or CR packaging, is defined in 16 C.F.R. §1700.1 (b)(4) as "packaging that is designed or constructed to be significantly difficult for children under 5 years of age to open or obtain a toxic or harmful amount of substance contained therein within a reasonable time and not difficult for normal adults to use properly, but does not mean packaging which all such children cannot open or obtain a toxic or harmful amount within a reasonable time." Products requiring special packaging include all prescription medications and over-the-counter medications, and a variety of other substances that are harmful if handled, used, or ingested. Child resistant blister packages are also desirable for packaging any other type of article that is unsafe for a child, such as medical instruments, sharp objects, or addictive substances (e.g., caffeine, nicotine, etc.).

A variety of manners of forming a child-resistant blister package are known in the art. For instance, a peel-and-push type blister package generally requires sufficient cognitive skills to render the package child-resistant. Tear-access type blister packages may be formed of a tear-resistant material that is nearly impossible to tear unless the material is weakened (such as by perforations) and a minimum amount of force, generally greater than within the capacity of a child, is used. Child-resistant blister packages must, however, take into account the needs of the adults who are to access its contents. In particular, the child-resistant blister package should be designed to permit senior and physically disabled adults to open the package readily. If the tear resistance of a child-resistant tear-access blister package is reduced for ready opening by a senior or physically disabled adult, then there is a risk that a child may open such package as well.

Additional features (e.g., requiring folding, tearing, or stripping to gain access to the content of the product well) may be required to add a further step beyond the cognitive skills of small children. Thus, a high tear resistance may not be necessary for a tear-access blister package to still qualify as child resistant. For instance, a tear-initiating notch (generally required in tear-resistant blister packages for initiating a tear) may be inaccessible unless the blister card is folded over, such as disclosed in U.S. Pat. Nos. 3,809,220 to Arcudi and 5,511,665 to Dressel et al. Alternatively, a portion of the blister card may have to be removed first in order to permit tearing of the package to access the contents of the blister, as disclosed in U.S. Pat. No. 6,422,391 to Swartz. The requirement of tearing at a particular location on the blister package also elevates the cognitive skills required to open the package, such as requiring initial tearing through a peripheral tearing blister, as disclosed in U.S. Pat. No. 6,036,016 to Arnold. Another added step elevating the cognitive skills required to open the blister package beyond those of a typical child may be to require manipulation of the medication in the blister before rupturing the blister package to access the medication, such as disclosed in U.S. Pat. Nos. 4,371,080 to Haines and 5,529,188 to Coggswell.

There remains a continuing desire in the industry to improve the child-resistant features of tear-access blister packages to improve consumer friendliness and ease of opening for adults, including senior and physically disabled adults.

SUMMARY OF THE INVENTION

The present invention provides a blister package that is particularly suitable for limited access or child-resistant applications. Preferably, the force required to open a child-resistant tear-access blister package formed in accordance with principles of the present invention is not so great that a senior or physically disabled adult would have difficulty opening such package. Thus, in accordance with the principles of the present invention, the child-resistant features of the blister package of the present invention rely on requiring a level of cognitive skills to open the package beyond those of a child (at least of the age specified in Title 16 of the C.F.R., Part 1700) yet well within those of senior or physically disabled adults.

A tear-access blister package formed in accordance with the principles of the present invention requires multiple steps in order to access the product contained within the blister well, yet preferably does not require a high degree of force or strength to be opened. In a preferred embodiment, the tear-access blister package is relatively easy to tear open, but the tearing action is interrupted so that at least one additional step must be performed (preferably other than tearing) in order to access the contents of the package. For instance, in the embodiment described herein, a tear-resistant blister channel is provided in the tear path (from the peripheral edge of the blister package where the tear is initiated to the product well) so that the tear-resistant blister channel must be weakened (such as by snapping or simple bending) in order to continue tearing the blister package toward the product well to access the product. Such additional step achieves a greater level of child-resistancy than achievable by merely increasing the force required to tear the package. Moreover, the interruption of tearing of the package toward the product well results in what essentially is a three step process for opening the package—(1) initial tearing, (2) weakening the tear-resistant blister channel, and then (3) continuing to tear again.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows:

FIG. 1 is a perspective view of a blister package formed in accordance with the principles of the present invention;

FIG. 2 is a side elevational view of the blister package of FIG. 1;

FIG. 3 is a plan view of the blister package of FIG. 1;

FIG. 7 is a perspective view similar to that of FIGS. 4-6, showing a tear that has propagated through the tear-resistant blister channel; and FIG. 8 is a perspective view similar to that of FIGS. 4-7, showing a tear that has propagated to the product well to grant access to the product within the product well.

DETAILED DESCRIPTION OF THE INVENTION

Figure 4:
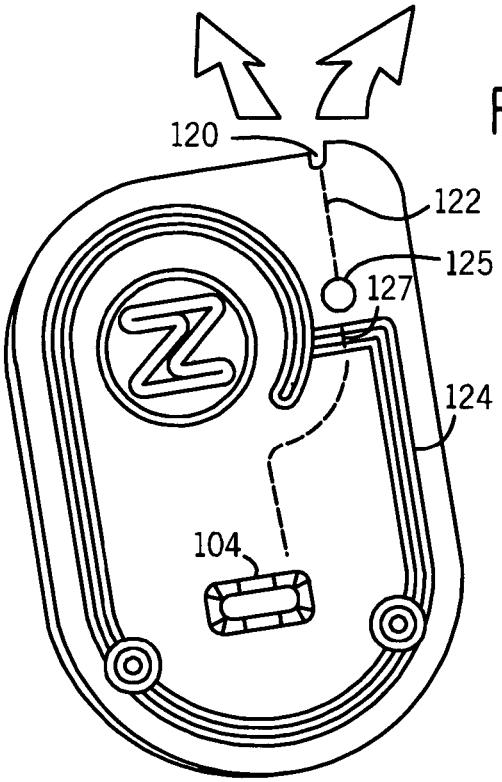
FIG. 4 is a perspective view of the blister package of FIG. 1, with a tear being initiated.

The principles of the present invention may be applied to blister packages for packaging any type of product that is not to be readily accessed by a child. Exemplary blister package 100, formed in accordance with principles of the present invention and illustrated in FIGS. 1-6, is made up of blister 102, in which at least one product well 104 is formed, and blister backing 106, as may be seen with particular reference to FIG. 2. Blister 102 and blister backing 106 preferably are coupled together to retain a product within product well 104. For example, blister 102 and blister backing 106 may be sealed together, such as by conduction or any sealing method known in the art, to prevent ready access to the product held therein. Depending on the product within product well 104, it may be desirable to form a hermetic seal about product well 104.

In the exemplary embodiments of FIGS. 1-8, product well 104 is shaped for holding or containing a medication, drugs, or pharmaceuticals (e.g., tablets, capsules, caplets, and the like; hereinafter "medications" for the sake of convenience, and without any intent to limit). However, it will be appreciated that product well 104 may be shaped to contain items of different sizes and shapes other than those for typical medications. Additional wells or cavities 110, 112, 114 may be formed, such as to provide brand information and/or a logo, such as illustrated by well 110. Alternatively, or additionally, at least three additional wells of equal height (and preferably the same height as product well 104) may be provided to facilitate stacking of blister packages 100 on top of each other for loading into a carton in an efficient manner.

Blister 102 may be formed from a rupture-resistant, semi-rigid material. Any conventional thermoformed material used in blister packaging, such as plastic, or cold-formable materials, such as plastics or foils or foil-plastic lamination, may be used. Preferred materials include PVDC, a combination of PVC/PE/PVDC, pharmaceutical grade PVC, or another thermoplastic material, such as plastic, polypropylene, polyethylene, styrene, cold-formed foil, or other suitable materials for packaging. The material may be a single ply or multiple plies or laminations. If desired, such material may be selected to retain a desired shape and to be crush resistant so that a friable product within product well 104 is retained therein without being damaged. If viewing of the product within product well 104 is desirable, then a plastic, rather than a foil, is used. Of course, compatibility of the blister material with the product to be contained within product well 104 (particularly when such product is a medication) is an important factor in selection of a material for blister 102. Barrier properties (e.g., in terms of moisture and oxygen protection) may also be an important consideration. For instance, a cold-formed foil is generally necessary for stability of more hydroscopic medications, such as chewable medications. Protection from UV light may also be an important consideration for certain products, requiring translucent or opaque material to be used for blister 102. Any other characteristics that would contribute to stability of the product may affect the selection of material for forming blister 102.

In order to prevent the product held within product well 104 from being pushed through blister backing 106 (and thus rendering the blister package 100 not child-resistant), blister backing 106 is preferably formed from a rupture and puncture resistant material, such as a tear-resistant lamination. Preferably, the material of blister backing 106 is selected to be compatible with the material of blister 102, such as for heat sealability. Additionally, as with blister 102, compatibility of the blister material with the product to be contained within product well 104, barrier properties (as described above), UV protection, and other characteristics (such as, but not limited to, those that would contribute to stability of the product) may be important considerations in selecting the material of blister backing 106. Exemplary materials that may be used for blister backing 106 include, without limitation, PET, a PET foil lamination, or some other lamination of oriented polypropylene. If desired, the material of blister backing 106 may be substantially rigid to retain the overall stiffness of blister package 100. However, the rigidity of blister 102, or the rigidity resulting upon coupling of blister 102 with blister backing 106 may be sufficient such that relative rigidity of blister backing 106 is unnecessary.

Because blister package 100 is preferably a tear-access blister package, tearability of the materials used to form blister package 100 is generally a factor in selecting the materials. Generally, if blister package 100 is to have a degree of child-resistance, the material of blister 102 and/or the material of blister backing 106 is selected to be at least somewhat tear-resistant. The degree of tear resistancy is based on the level of child-resistancy desired or necessary for the blister package. The tear resistance of the blister material or the tear-resistance resulting from coupling the blister and the blister backing may be sufficient such that the blister backing material need not be tear resistant. Likewise, the tear resistance of the blister backing material or the tear-resistance resulting from coupling the blister backing and the blister may be sufficient such that the blister material need not be tear resistant. The sealing of blister 102 and blister backing 106 may together further strengthen the overall tear-resistance of blister package 100.

Generally, the material of blister 102 and/or the material of blister backing 106 is selected to be tearable only when weakened, such as by cuts, nicks, scores, perforations, or other lines of weakening (hereinafter "weakening(s)" will be used to refer to all such weakenings for the sake of convenience only, and with no intent to limit). The particular type of weakening may be selected based on the level of child-resistancy required, or other various factors (including, but not limited to, tamper-evidency desired, or machining or other manufacturing constraints). For instance, perforations typically provide a cleaner break than do scoring, and are typically easier to form (regulation of the depth of a score line in a relatively thin material generally requires a higher degree of control than required to completely cut through a material such as to create perforations). The land areas between the perforations may be varied to alter the ease of tearing therethrough. In addition, the material of blister 102 and/or the material of blister backing 106 may be oriented to facilitate tearing in a particular direction. It will be appreciated that the materials of blister 102 and blister backing 106 may be selected so that they may be cut through with scissors.

Blister package 100 as a whole preferably is resistant to being torn or opened at places other than along weakenings. Thus, an initial weakening, such as a tear notch 120, may be provided at least one location along the peripheral edge of blister package 100, as illustrated in FIGS. 3 and 4. In the embodiment illustrated in FIGS. 1-8, blister package 100 is oblong with product well 104 at one end (along the major axis of the package) and initial tear notch 120 at the other end, such that use of initial tear notch 120 to access the product well 104 at the opposite end of blister package 100 is not necessarily intuitive for a young child. However, it will be appreciated that other configurations are well within the scope of the present invention. Initial tear notch 120 may lead to an initial weakening 122 that further facilitates tearing of blister package 100 to access the contents of product well 104. Although initial tear notch 120 is illustrated in FIG. 3 as a notch, initial tear notch 120 need not specifically be shaped as a notch, and may be any other modification to blister package 100 that facilitates tearing therethrough. For instance, a simple cut through the material of blister package 100 may be provided. Alternatively, initial weakening 122 may be provided spaced a short enough distance from the peripheral edge of blister package 100 to facilitate initial tearing specifically near such weakening, yet creating a land area between initial weakening 122 and the peripheral edge of blister package 100 small enough as to not be readily apparent to a child. Such design would result in a package that is moderately difficult to start tearing, but once tearing has been initiated and the weakening reached, is relatively easy to continue tearing. Preferably, sufficient blister packaging material (i.e., the combined layer of blister 102 and blister backing 106) is provided to grasp the packaging adequately to initiate tearing. As in the embodiment of FIGS. 1-8, initial tear notch 120 may be offset from the central axis of blister package 100 to facilitate grasping of a sufficient surface area of blister package 100 with one hand while grasping the smaller remaining surface area of blister package 100 to tear blister package 100.

Figure 5:
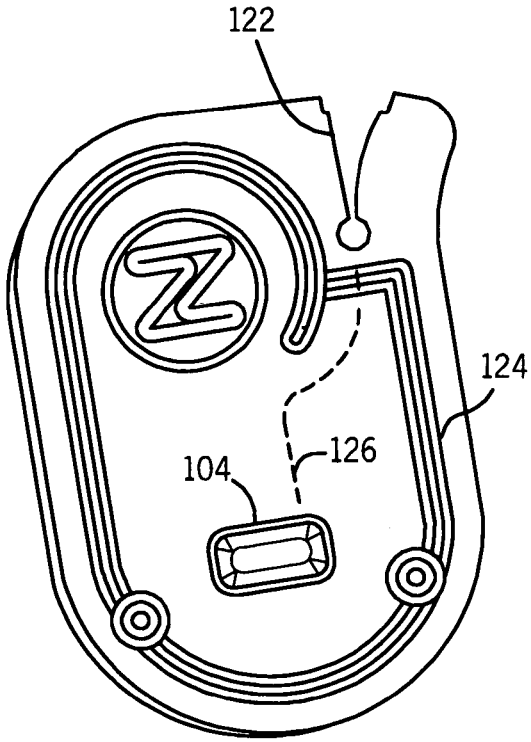
FIG. 5 is a perspective view similar to that of FIG. 4, but with tearing interrupted by an optional keyhole.

In accordance with the principles of the present invention, simple tearing of blister package 100 is inhibited to result in a child-resistant blister package that is nonetheless readily opened by senior and physically disabled adults. More particularly, an action in addition to simple tearing must be performed to gain access to the content of product well 104. In the embodiments of FIGS. 1-8, the presence of a tear-resistant channel 124 in the tear path from the edge of blister package 100 toward product well 104 interferes with further propagation of the initial tear through blister package 100. If desired, initial weakening 122 in blister package 100 may optionally end (in a direction away from the peripheral edge of blister package 100 and toward product well 104) at a keyhole 125, which further inhibits further tearing along initial weakening 122 upon reaching tear-resistant channel 124, as illustrated by FIG. 5. The spacing of keyhole 125 from tear-resistant channel 124 is determined based on the desired tear-resistant affect, and is influenced by such factors as the tear-resistance of the material(s) of blister package 100. It is believed that the configuration of tear-resistant channel 124 interferes with the propagation of the initial tear because the direction of tearing (initially within the major plane of blister package 100) is altered, requiring deflection of the direction of tearing force applied to blister package 100. Such interference generally results in enough deterrence that a small child loses interest in opening blister package 100, thereby adding a level of child-resistance to blister package 100. Tear-resistant channel 124 may also serve an additional function of stiffening blister package 100 so it does not warp or otherwise bend or deform. If desired, tear-resistant channel 124 may extend around the entire periphery of blister package 100, encircling product well 104, as illustrated in the exemplary embodiment of FIGS. 1-8, thereby adding a further level of child-resistance.

Figure 6:
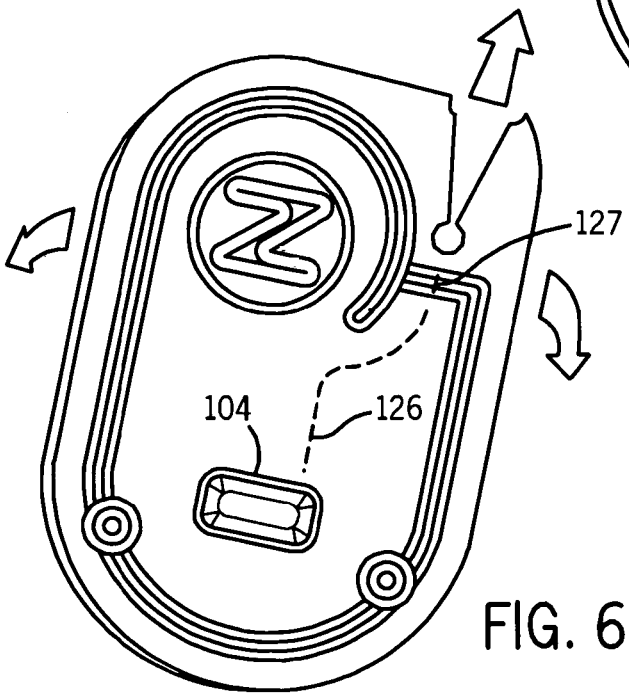
FIG. 6 is a perspective view similar to that of FIG. 5, but with tearing interrupted by a tear-resistant blister channel which must be further manipulated.

Because tear-resistant channel 124 does not readily tear, an action in addition to tearing must be performed in order to continue tearing blister package 100 to access the contents of product well 104, as illustrated conceptually by FIG. 6. Generally, manipulation of tear-resistant channel 124 to weaken tear-resistant channel 124 is required. For instance, if the material of blister 102 is relatively frangible, then breaking or snapping of tear-resistant channel 124 may be necessary in order to continue tearing blister package 100 toward product well 104. Alternatively, simple bending of tear-resistant channel 124 may suffice to weaken tear-resistant channel 124 sufficiently to permit tearing therethrough. As will be appreciated, various characteristics of the material of tear-resistant channel 124 will affect if it breaks or bends. The size and shape of tear-resistant channel 124 may be modified to enhance or to affect the interference it creates in opening blister package 100 and its consequent affect on the child-resistancy of blister package 100. If desired, tear-resistant channel 124 may be weakened, such as by a nick 127 (see FIGS. 3-6).

Once tear-resistant channel 124 has been sufficiently weakened or otherwise manipulated to permit tearing therethrough, tearing may proceed toward product well 104, as illustrated conceptually by FIG. 7. If desired (generally depending on the desired child resistancy of blister package 100 and the materials of blister-102 and blister backing 106) an additional weakening 126 may be provided to facilitate propagation of the tear from tear-resistant channel 124 toward product well 104. In view of typical stability requirements of the product additional weakening 126 preferably ends a short distance from product well 104, as illustrated in FIG. 7, to maintain the integrity of the seal of product well 104. The industry standard typically requires a cut in the blister package to be no more than approximately 2-4 mm from the seal of the product well. Tearing into product well 104 once the end of additional weakening 126 has been reached is relatively simply achieved to reach the contents of product well 104, as illustrated in FIG. 8.

The formation of blister package 100 of the present invention may be achieved in accordance with any desired method of manufacture achieving the child-resistant features of the present invention. For instance, blister 102 and blister backing 106 may be supplied as separate rolls of material to a blister-package-forming machine (machines such as those sold by Uhlmann Packaging Systems, Inc. of Towaco, N.J., or Klöckner Pentaplast, of Gordonsville, Va., may be used). The blister material may be unrolled and passed through a forming section at which blister sections such as product well 104, tear-resistant channel 124, and additional wells 110, 112, 114, may be formed, such as by vacuum pressure, thermoforming, or a mechanical deformation process. For instance, the blister material may be stretched into a cavity with a vacuum applied thereto to form blister sections. Alternatively, the blister material may be exposed to heating elements for a pre-determined time, and then trapped in a forming station where the blister material is subjected to both vacuum and pressure. During this process, the blister material may also be mechanically assisted into the blister cavity or mold via a matched metal plug to form any or all of the blister sections. The blister sections can alternatively be formed by using cold-formed foil and cold-form packaging processes.

Once blister sections are formed in blister 102, a product is placed in product well 104. Backing layer material may then be fed from a roll and sealed to blister 102 and the bottom of the filled product well 104 to seal the product within product well 104 and blister package 100. Blister 102 and the blister backing 106 may be joined together by any sealing method known in the art that adequately seals a product within product well 104. For instance, if the product has a low stability or shelf-life such that an air-tight seal is necessary, then the materials of blister 102 and blister backing 106 and the sealing method are selected to achieve an air-tight seal around product well 104. Exemplary sealing methods include heat sealing, adhesive seals (such as with heat-activated or solvent adhesive), RF or sonic seals, or any other suitable means. Typically, conductive sealing through heated plates (e.g., a thermoforming operation) is used. The materials of blister 102 and the blister backing 106 may be pre-treated to facilitate sealing of such materials together. For instance, a coating may be applied to either or both materials to permit heat sealing (generally necessary with foils that do not readily heat seal to PVC or PVDC).

Weakenings, such as described above, may be formed at any desired stage of forming blister package 100. For ease of manufacturing, blister package 100 is passed through equipment designed to form the desired type of weakenings once product wells 104 have been filled and blister 102 and backing layer 106 are sealed together. Once blister package 100 has been formed with its desired child-resistant features, it may be passed through die-cutting equipment for separation from the rolls of blister and blister backing materials. If a nick is provided on the tear-resistant channel (depending on the level of child-resistance required), it may be formed in the thermoforming mold or at the section at which the other weakenings are created.

As should be appreciated from the foregoing, a blister package formed in accordance with the principles of the present invention is simple in construction, can be made economically and relatively simply, provides a protective environment for products, and can be readily opened without the use of utensils, such as scissors or knives, but cannot readily be opened by children.

While a blister package formed in accordance with the principles of the present invention is particularly shown and described herein with reference to the particular embodiment illustrated in the drawings, it is to be understood that the present invention may be used with many additions, substitutions, or modifications of form, structure, arrangement, proportions, materials, and components and otherwise, used in the practice of the invention, which are particularly adapted to specific environments and operative requirements without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. For instance, more than one product well may be provided in blister package 100. Moreover, the blister package itself may be formed as an individual unit, or in a sheet, strip, matrix, or array of packages which may be joined for ready separation (such as by weakenings such as tear-apart perforations) into individual units. The presently disclosed embodiments are therefore to be considered in all respects as illustrative and not restrictive, the scope of the invention being indicated by the appended claims, and not limited to the foregoing description.

What is claimed is:

1. A blister package comprising:

a blister formed of a rupture-resistant, semi-rigid material having at least one product well pre-formed therein and a tear-resistant element pre-formed therein spaced apart from said pre-formed product well and completely surrounding and enclosing said pre-formed product well;

a blister backing coupled to said blister to enclose said at least one pre-formed product well to enclose a product between said blister and said blister backing; and a weakening formed in said blister and said blister backing in a direction from said peripheral edge toward said pre-formed product well to facilitate tearing of said blister package to access the product in said pre-formed product well;

wherein:

said pre-formed product well and said pre-formed tear-resistant element are pre-formed in said blister before said blister is coupled to said blister backing;

said pre-formed product well and said pre-formed tear-resistant element are spaced apart from each other by a portion of said blister package comprising said blister and said blister backing;

said weakening is configured to facilitate tearing of said blister package through and along said weakening from said peripheral edge of said blister package to said pre-formed tear resistant element, and ends at a keyhole spaced apart from said pre-formed tear-resistant element to inhibit further tearing of said blister package along said weakening; and said weakening is interrupted along a path from said peripheral edge to said pre-formed product well by said pre-formed tear-resistant element such that an action in addition to tearing along said weakening must be performed in order to continue tearing from said tear-resistant element through said portion of said blister package positioned between said tear-resistant element and said pre-formed product well to access the product in said pre-formed product well.

2. A blister package as in claim 1, wherein:

said pre-formed tear-resistant element is a blister channel pre-formed in only said blister between said peripheral edge of said blister package and said pre-formed product well to result in an area of blister separated from said blister backing.

3. A blister package as in claim 2, wherein:

said blister package is tear resistant;

said weakening is formed to overcome the tear-resistancy of said blister package to facilitate tearing of said blister package along said weakening to access said pre-formed product well; and said blister channel is a pre-formed tear-resistant blister channel.

4. A blister package as in claim 3, wherein manipulation of said pre-formed tear-resistant blister channel is required to weaken said pre-formed tear-resistant blister channel.

5. A blister package as in claim 4, wherein said manipulation includes snapping or bending said pre-formed tear-resistant blister channel.

6. A blister package as in claim 4, wherein a nick is formed in said pre-formed tear-resistant blister channel to facilitate weakening of said pre-formed tear-resistant blister channel.

7. A blister package as in claim 2, wherein:

said weakening comprises: a first weakening extending from said peripheral edge of said blister package toward said pre-formed blister channel and ending at said pre-formed blister channel; and a second weakening extending from said pre-formed blister channel, through said portion of said blister package comprising blister and blister backing spacing apart said pre-formed tear-resistant element and said pre-formed product well, and toward said pre-formed product well; and said pre-formed blister channel separates said first and second weakenings from each other.

8. A blister package as in claim 1, wherein:

said blister package is oblong with a major axis having a first end and a second end;

said pre-formed product well is adjacent said first end of said major axis; and an initial weakening is provided at a peripheral edge of said blister package adjacent said second end of said major axis.

9. A blister package having a peripheral edge, said blister package comprising:

a blister formed of a rupture-resistant, semi-rigid material having at least one product well pre-formed therein and a blister channel pre-formed therein spaced apart from said pre-formed product well and extending completely around said pre-formed product well to completely encircle said pre-formed product well to enclose said pre-formed product well completely within said pre-formed blister channel;

a blister backing coupled to said blister to enclose said at least one pre-formed product well to enclose a product between said blister and said blister backing; and a weakening formed in said blister and said blister backing extending from said peripheral edge to said pre-formed blister channel to facilitate tearing of said blister package to access the product in said pre-formed product well;

wherein:

said pre-formed blister channel is formed in said blister as a pre-formed section of said blister spaced apart from and not coupled to said blister backing, formed before said blister is coupled to said blister backing;

a portion of said blister package comprising said blister coupled to said blister backing is provided between said pre-formed blister channel and said pre-formed product well spacing apart said pre-formed blister channel from said pre-formed product well;

said weakening is configured to facilitate tearing of said blister package through and along said weakening from said peripheral edge of said blister package to said pre-formed blister channel, and ends at a keyhole spaced apart from said pre-formed blister channel to inhibit further tearing of said blister package along said weakening; and tearing of said blister package from said peripheral edge to said pre-formed product well is interrupted by said pre-formed blister channel such that an action in addition to tearing must be performed to tear said blister package through said pre-formed blister channel and then through said portion of blister and blister backing between said pre-formed blister channel and said pre-formed product well to access the product in said pre-formed product well.

10. A blister package as in claim 9, wherein:

at least one of said blister, said blister backing, or the combination of said blister with said blister backing imparts tear resistancy to said blister package;

a second weakening is formed in said portion of blister package between said pre-formed blister channel and said pre-formed product well extending from said pre-formed blister channel toward said pre-formed product well, said pre-formed blister channel separating said weakening from said second weakening; and said pre-formed blister channel is formed to separate said weakening from said second weakening to interrupt tearing of said blister package from said peripheral edge toward said pre-formed product well.

11. A method of forming a blister package comprising:

forming at least one product well and a tear-resistant element spaced apart from and completely surrounding and enclosing said product well in a semi-rigid blister;

coupling said blister with said at least one pre-formed product well and said pre-formed tear-resistant element to a blister backing to enclose said at least one pre-formed product well to enclose a product between said blister and said blister backing; and forming a weakening in said blister and said blister backing to extend from a peripheral edge of said blister package toward said pre-formed product well to facilitate access to a product in said pre-formed product well by tearing said blister package along said weakening;

wherein:

said weakening is formed to end at a keyhole spaced apart from said pre-formed tear resistant element to inhibit further tearing of said blister package along said weakening; and said pre-formed tear-resistant element is formed in said blister prior to coupling said blister to said blister backing, and is configured to require an action in addition to tearing in order to continue tearing said blister and blister backing through said pre-formed tear-resistant element, and then through a portion of blister and blister backing between said tear-resistant element and said pre-formed product well to tear said blister package to said pre-formed product well to access a product in said pre-formed product well.

12. A method as in claim 11, wherein forming said tear-resistant element comprises forming a blister channel in said blister in the path of weakening between the peripheral edge of said blister package and said pre-formed product well prior to coupling said blister to said blister backing.

13. A method as in claim 12, further comprising forming said blister channel around the entire periphery of said blister package to encircle said pre-formed product well prior to coupling said blister to said blister backing.

14. A method as in claim 12, further comprising forming said weakening as a first weakening extending through said blister and said blister backing from the peripheral edge of said blister package toward said pre-formed blister channel and a second weakening extending through said blister and said blister backing from said pre-formed blister channel toward said pre-formed product well, said blister channel separating said first and second weakenings from each other.

15. A method as in claim 14, further comprising forming said first weakening to facilitate tearing of said blister and said blister backing through and along said first weakening to a distance spaced apart from said pre-formed blister channel to further inhibit tearing of said blister and blister backing upon reaching said pre-formed blister channel.

16. A method of opening a tear-access child-resistant blister package having a peripheral edge and a product well pre-formed in a pre-formed blister, said blister with said pre-formed product well being coupled to a blister backing to contain a product in said pre-formed product well between said pre-formed blister and said blister backing and spaced from said peripheral edge, said method comprising:

tearing said blister package within the major plane of said blister package from said peripheral edge, along a weakening, and toward said pre-formed product well until reaching a keyhole spaced apart from a tear-resistant element pre-formed in said pre-formed blister to completely surround and encircle said pre-formed product well prior to coupling of said pre-formed blister to said blister backing, said tear-resistant element requiring an action other than tearing said blister package within the major plane of said blister package;

bending said pre-formed tear-resistant element, after initially tearing said blister package from said peripheral edge up to said keyhole spaced apart from said pre-formed tear-resistant element, to weaken said pre-formed tear-resistant element to permit further tearing of said blister package through said pre-formed tear-resistant element and toward said pre-formed product well; and only after sufficiently further manipulating said pre-formed tear-resistant element, continuing to tear through said pre-formed tear-resistant element and through a portion of blister and blister backing between said pre-formed tear-resistant element and said pre-formed product well to access the product within said pre-formed product well.

17. The method of claim 16, wherein further manipulating said pre-formed tear-resistant element comprises bending a pre-formed blister channel in the tear path from said peripheral edge to said pre-formed product well.

18. The method of claim 17, further comprising bending said pre-formed blister channel to snap said pre-formed blister channel.

19. A blister package as in claim 1, wherein an initial weakening, separate from said weakening, is provided at a peripheral edge of said blister package.

* * * * *